US005683029A

United States Patent [19]

Lyons

[11] Patent Number: 5,683,029

[45] Date of Patent: Nov. 4, 1997

[54] COMBINATION SEALING AND OPENING STRIP FOR PACKAGES

[75] Inventor: Joseph N. Lyons, Wilbraham, Mass.

[73] Assignee: Ludlow Corporation, Exeter, N.H.

[21] Appl. No.: 637,135

[22] Filed: Apr. 24, 1996

[51] Int. Cl.[6] ..... B65D 27/38

[52] U.S. Cl. ..... 229/309; 229/313; 229/80; 383/205; 383/207

[58] Field of Search ..... 229/309, 310, 229/311, 80, 313; 383/205, 206, 207, 5

[56] References Cited

U.S. PATENT DOCUMENTS

| | | | |
|---|---|---|---|
| 484,733 | 10/1892 | Flynn | 229/309 |
| 1,717,698 | 6/1929 | Lawhorn | 229/309 X |
| 2,859,907 | 11/1958 | McFarland . | |
| 2,954,916 | 10/1960 | Mela | 229/310 |
| 2,962,205 | 11/1960 | McFarland | 229/309 |
| 3,217,871 | 11/1965 | Lee . | |
| 3,674,844 | 7/1972 | Sorrell . | |
| 4,460,364 | 7/1984 | Chen et al. . | |
| 4,468,811 | 8/1984 | Shaw et al. . | |
| 4,509,196 | 4/1985 | Sak et al. . | |
| 4,510,621 | 4/1985 | Sak et al. . | |
| 4,580,683 | 4/1986 | Gochenour | 383/205 |
| 4,607,749 | 8/1986 | Jacob . | |
| 4,749,084 | 6/1988 | Perevra . | |
| 4,785,950 | 11/1988 | Wilson . | |
| 4,795,456 | 1/1989 | Borgers et al. . | |
| 4,819,807 | 4/1989 | Giger . | |
| 4,903,844 | 2/1990 | Oglesby . | |
| 4,931,327 | 6/1990 | Liu et al. . | |
| 4,937,040 | 6/1990 | Holcomb et al. . | |
| 4,988,547 | 1/1991 | Voto, Jr. et al. | 383/5 X |
| 5,035,518 | 7/1991 | McClintock . | |
| 5,046,621 | 9/1991 | Bell . | |
| 5,056,930 | 10/1991 | Mestetsky . | |
| 5,060,848 | 10/1991 | Ewan . | |
| 5,217,307 | 6/1993 | McClintock | 383/5 X |
| 5,308,695 | 5/1994 | Arakawa et al. . | |
| 5,499,757 | 3/1996 | Back | 383/5 X |

FOREIGN PATENT DOCUMENTS

| | | | |
|---|---|---|---|
| 732937 | 4/1966 | Canada | 383/206 |
| 400750 | 4/1966 | Switzerland | 229/309 |
| 8912582 | 12/1989 | WIPO . | |
| 9104199 | 4/1991 | WIPO | 383/5 |

*Primary Examiner*—Jes F. Pascua

*Attorney, Agent, or Firm*—Richard H. Kosakowski, Esq.; Holland & Bonzagni, PC

[57] ABSTRACT

A combination sealing and opening strip for various types of packages comprises a three-layer laminate strip having a centrally-located, high strength membrane with pressure-sensitive adhesive on both sides of the membrane. The membrane comprises a material, such as MYLAR® flexible synthetic film, polyester, other polymeric films, fiberglass, or fibrous or non-fibrous materials of various compositions with a strength greater than that of the package material. This provides for a controlled tearing of the package material. During strip manufacture, the adhesive-coated strip is laminated in precise registration onto a differentially-coated release liner. The combination strip and release liner are applied to the package material in a location such as the flap of a common overnight envelope. When sealing the package, the user peels the release liner from the strip. The flap is folded down such that the exposed adhesive-coated side of the strip contacts the package material in a desired location, which seals the package. Preferably, the strip is narrower in width than the release liner. This creates a "finger lift dry edge" or overlap of the release liner, which makes it easier to grasp and remove the release liner from the strip when sealing the package. The package has die-cut areas which provide user convenient points to grasp the combination of package material and opening strip, thus providing a convenient method to open the package.

14 Claims, 3 Drawing Sheets

COMBINATION SEALING AND OPENING STRIP FOR PACKAGES

BACKGROUND OF THE INVENTION

This invention relates to providing various packages, such as envelopes, boxes, cartons and pouches, with a tamper-resistant, secure sealing strip that also provides for easy, intuitive, package-opening characteristics; both the means for sealing and the means for opening being conveniently provided together in one article of manufacture.

Many different package types all simultaneously require a high degree of tamper resistance, convenience of secure sealing and structural integrity during package transit, along with customer ease of package opening. In the prior art of sealing methodologies and articles, it is known to use water moisturizing gums (e.g., on common letter envelopes), pressure-sensitive adhesives and sealing tapes. All of these offer various degrees of sealing integrity, tamper resistance and ease of opening. However, each of these known approaches has fundamental limitations. For example, high humidity can prematurely activate water gum adhesives. Permanent pressure-sensitive, fiber-tearing adhesives have inherent limitations in only allowing one-time opening of a package (i.e., they cannot be used on a resealable package). Sealing tapes may fail unless designed for the specific package materials.

Further, water gum adhesives are cumbersome to use in that they require the user to moisten the gum area adequately while not over-moistening the adhesive such that the gum is removed. The user must then quickly seal the package during the "open" or moist time of the adhesive gum, which typically is only a short period of time. On the other hand, pressure-sensitive adhesives require additional release paper masks or liners, or require reverse folds formed in the package, to prevent premature sealing to undesired materials. Spot applications of these materials pose manufacturing problems and inadvertent voids which can affect the viability of a secure seal. Sealing tapes are often applied by users as "insurance" over gum or pressure-sensitive seals to insure security. However, this adds to the cost and complexity of the sealing system.

Many prior art approaches have been developed to design package "tear-tab" opening devices with or without independent structural materials. The simplest package tear-tab is one without any independent structural material that is comprised of a series of parallel perforations formed in the package material such that the tear-tab is defined between the perforations. Through alignment in a parallel fashion, these perforations suggest that one end of the tab, once lifted, can be held in the fingers and torn the length or width of the package between the parallel perforated lines. Once the tab is torn, the perforations release a previously secured flap (which was secured by a separate sealing means such as a glue), thereby opening the package. This system owes its popularity to the ease in which the package manufacturer can perforate materials.

However, the level of effectiveness of this relatively simplistic tear-tab for opening package materials is dependent upon many factors, and, thus, is not highly reliable. As the tab is being pulled along its length, the inherent strength of the package material surrounding the tab must be sufficient to overcome the stress or force required to break all of the remaining unperforated areas in the tear-tab zone. Otherwise, the package could tear in undesired areas, or may inadvertently open prematurely in transit. Reliability and integrity in package opening are thus complicated by variations in material strength, depth of perforations, sharpness of perforating blade, grain of package material, and other factors introduced by transit damage and user physical strength, angle of induced stress, speed of motion, and side-to-side stress applied during opening. Thus, while representing a simplistic approach, the perforated line approach has a number of inherent weaknesses.

Independent structural materials such as fiberglass or other high strength strips provide high reliability of opening since they can be designed to overcome package material strength. However, since these materials presently do not provide any sealing function, they require additional area on a package for a separate package opening article or device, beyond that area used for a package sealing means. This generally requires additional material to be provided in the package, e.g., for the flap. Until now, package manufacturers utilizing independent structural materials have provided for separate sealing and opening mechanisms in their package manufacturing systems. A common example is the two separate mechanisms used to seal and open, respectively, a common overnight-mail, fiberboard envelope.

Accordingly, it is a primary object of the present invention to provide a package, such as an envelope, box, carton or pouch, with an adhesive-coated strip that functions to both securely seal the package and to facilitate its opening in a controlled manner.

It is a general object of the present invention to provide the combination sealing and opening strip for a package such that no tearable lines of weakness or other special manufactured articles or devices are required to be formed across in the package material to facilitate the opening of the package.

It is another object of the present invention to provide a means for both sealing and opening a package without requiring the use of unsupported pull tabs to facilitate opening of the package.

It is yet another object of the present invention to provide the combination sealing and opening strip that provides for a high degree of tamper resistance through use of obvious visual evidence when the envelope is partially or completely opened by an unauthorized user.

Another object of the present invention is to provide the combination sealing and opening strip that can be easily adapted for use on a wide variety of packages, such as envelopes, cartons, boxes and pouches.

Still another object of the present invention is to provide the combination sealing and opening strip that is physically interfaced or mated with a corresponding release liner during manufacture, with the strip and release liner being spooled in a continuous manner that allows for relatively easy application to a desired location on a package.

Yet another object of the present invention is to provide package manufacturers and users with a single article that serves the dual purposes of secure sealing and opening the package, thereby reducing manufacturing costs and increasing reliability by eliminating the secondary process of applying tear strip material to packages already having sealing capability.

It is another object of the present invention to provide the combination sealing and opening strip for a package that allows for sealing of the package by pressure, instead of by moistening of glue or other messy, relatively more complicated means.

Still another object of the present invention is to provide the combination sealing and opening strip that seals a package in a high integrity manner such that the package can safely contain heavy and bulky contents that may shift in the package during transit or handling.

Yet another object of the present invention is to provide the combination sealing and opening strip that allows the package to be easily and intuitively opened with a simple pull of the strip and without the need to use implements such as sharp objects which can damage products or users.

Another object of the present invention is to provide the combination sealing and opening strip that can be easily manipulated by both right-handed and left-handed users.

It is still another object of the present invention to provide a simple seal for a package that is sealable with a flap.

Another object of the present invention is to provide the combination sealing and opening strip that is manufacturable in production quantities in a rapid manner and at low cost.

Still another object of the present invention is to provide the combination sealing and opening strip that comprises a multi-layer adhesive strip with desired adhesive qualities, wherein the strip has a simple, rectangular shape and is precisely registered or "zone-coated" onto a rectangular-shaped release liner using simple manufacturing techniques, and wherein the shapes of the strip and release liner lend themselves to easy, rapid and precise application and placement onto a desired location on various types of packages.

Yet another object of the present invention is to provide the combination sealing and opening strip that has a high adherence value providing tamper resistance when secure sealing the package thereby protecting the package against inadvertent opening during shipment; yet the adherence value is offset by the inherent design of this invention making it easy to open by virtually anyone.

The above and other objects and advantages of the present invention will become more readily apparent when the following description is read in conjunction with the accompanying drawings.

SUMMARY OF THE INVENTION

To overcome the deficiencies of the prior art and to achieve the objects listed above, the Applicant has invented a combination sealing and opening strip for use on numerous and various types of packages.

In a preferred embodiment, the combination sealing and opening strip comprises a three-layer laminated rectangular strip having a centrally-located, high strength membrane with pressure-sensitive adhesive laminated or coated on both opposing sides of the membrane. During manufacture and prior to usage on a package, the adhesive-coated strip is laminated in precise registration (i.e., "zone-coated") onto a differentially-coated release liner. The liner comprises a centrally-located, rectangular-shaped carrier having release material (e.g., silicone) laminated or coated (i.e., "differentially-coated") onto the opposing surfaces of the carrier.

Once the strip is applied to the package material in a location such as the flap of a common, overnight-mail document envelope, or the end or side panel of a box or carton, the user then merely has to remove the release liner from the strip to expose the adhesive on one side of the strip. The flap can then be folded down such that the exposed adhesive-coated side of the strip contacts the package material in a desired location, which will then seal the package in an effective, tamper-resistant manner.

The strip membrane is comprised of a high strength material, such as MYLAR® flexible synthetic film, polyester, other polymeric films, fiberglass, or fibrous or non-fibrous materials of various compositions, wherein the membrane material has a strength demonstratively greater than that of the package material. Also, the adhesive on both sides of the high-strength membrane is stronger than the surface strength of the package material. These characteristics of the membrane and adhesive provide for a controlled tearing of the package material (i.e., typically the package body material to which the flap is adhered). It also insures that the contents of the package are not damaged during opening.

Also, in a preferred embodiment, the strip is narrower in width than the width of the release liner. This creates a "finger lift dry edge" or overlap of the release liner with respect to the strip, which makes it easier for a user to grasp and remove (i.e., "peel") the release liner from the strip when it is desired to seal the package.

DETAILED DESCRIPTION OF THE PREFERRED EMBODIMENTS

Figure 1:
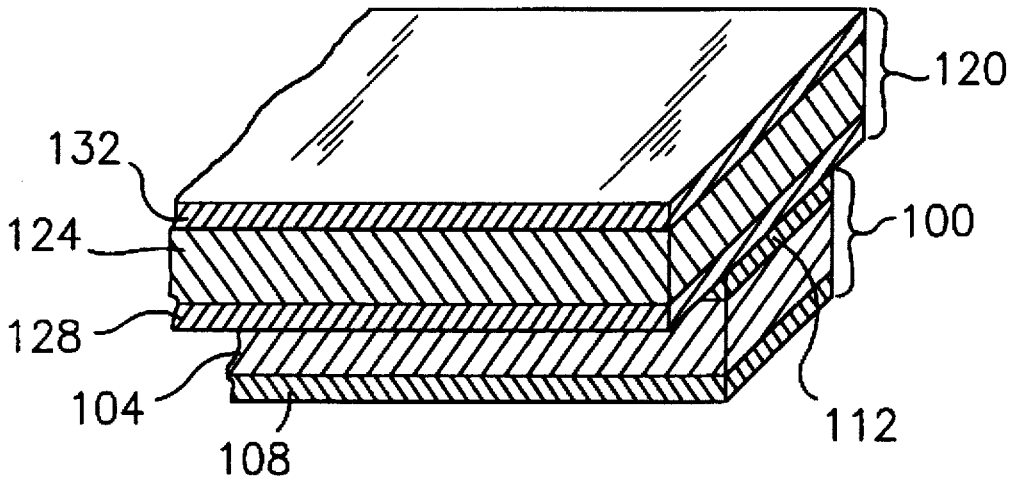
FIG. 1 is a cross-sectional view of a three-layer strip of the present invention laminated to a three-layer release liner.

Referring to the drawings in detail, there illustrated is a combination sealing and opening strip for use on a wide variety of packages, such as, without limitation, envelopes, boxes, cartons, or pouches, with the combination strip being generally designated therein by the reference numeral 100. With particular reference to FIGS. 1–5, in a preferred exemplary embodiment the strip 100 comprises a three-layer laminate article having a centrally-located, high strength, flat, rectangular-shaped membrane 104 with permanent pressure-sensitive adhesive layers 108, 112 laminated or coated on both opposing surfaces or sides of the membrane 104. During manufacture of the strip 100 and prior to its usage on a package 116 (such as the common overnight-mail document envelope of FIGS. 3–5), the adhesive-coated strip 100 is laminated to a three-layer, differentially-coated release liner 120.

The center membrane 104 disposed between the adhesive layers 108, 112 may comprise a high strength material, such as, without limitation, MYLAR® flexible synthetic film, polyester, other polymer films, fiberglass, or fibrous or non-fibrous materials of various compositions that are commercially-available. To allow for proper tearing of the package material during package opening (as discussed in greater detail hereinafter), the strength of the material comprising the high strength membrane 104 is greater than that of the package material in the vicinity of the location of the strip 100 on the package 116. With proper design consideration wherein the material comprising the strip membrane 104 is stronger than the package material, the strip 100 of the present invention avoids the manufacturing and use failures associated with prior art, die-cut tearing strips that exhibit various degrees of reliability in manufacturing and consumer use.

Since the center membrane 104 disposed between the adhesive layers 108, 112 preferably comprises a high strength material, the fingers can pull through the fiberboard, cardboard or other material comprising the package 116 in the vicinity of the strip 100 (FIGS. 4 and 5) in a manner that provides a tear-tab to controllably cut or tear through the package material and open the package 116 without damaging its contents. Also, because the material comprising the high strength membrane 104 is also preferably relatively flexible, the strip 100 can be used on packages 116 that are either three-dimensional or of a relatively flat nature. The strip 100 conforms well to package materials that are foldable for boxes or, in the case of envelopes, when the envelope material is rigid or flexible.

The high strength membrane 104 is illustrated as being in a flat strip form. However, alternatively, the membrane 104 may be in the form of a wire, string or rope having a shape other than flat, such as cylindrical. The shape of the high strength membrane 104 is irrelevant to the broadest scope of the present invention.

Figure 3:
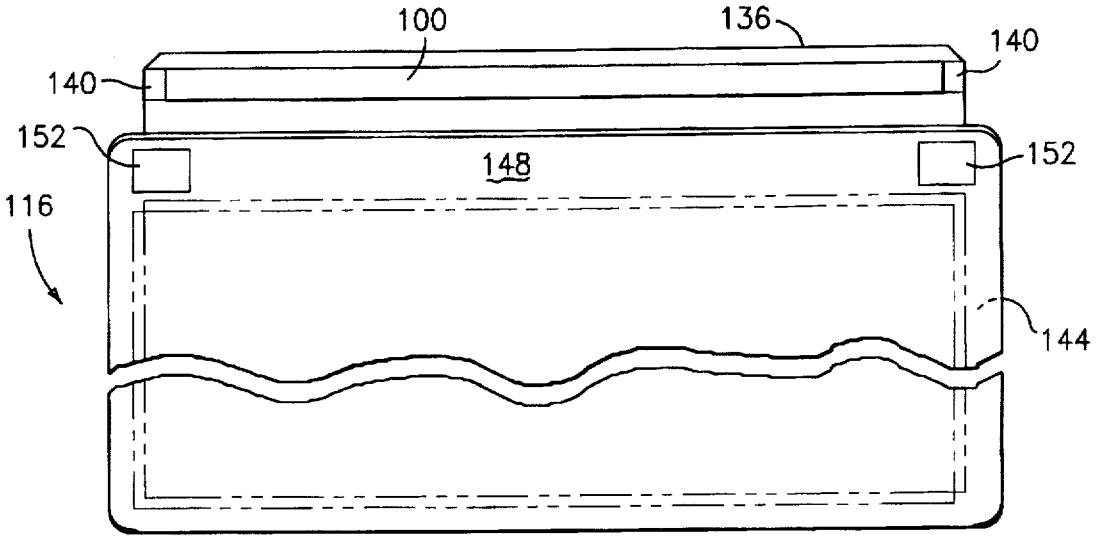
FIG. 3 is an application side view of the combination strip and release liner of FIG. 1 disposed onto the inside of the flap of a common, overnight-mail, document envelope.
Figure 4:
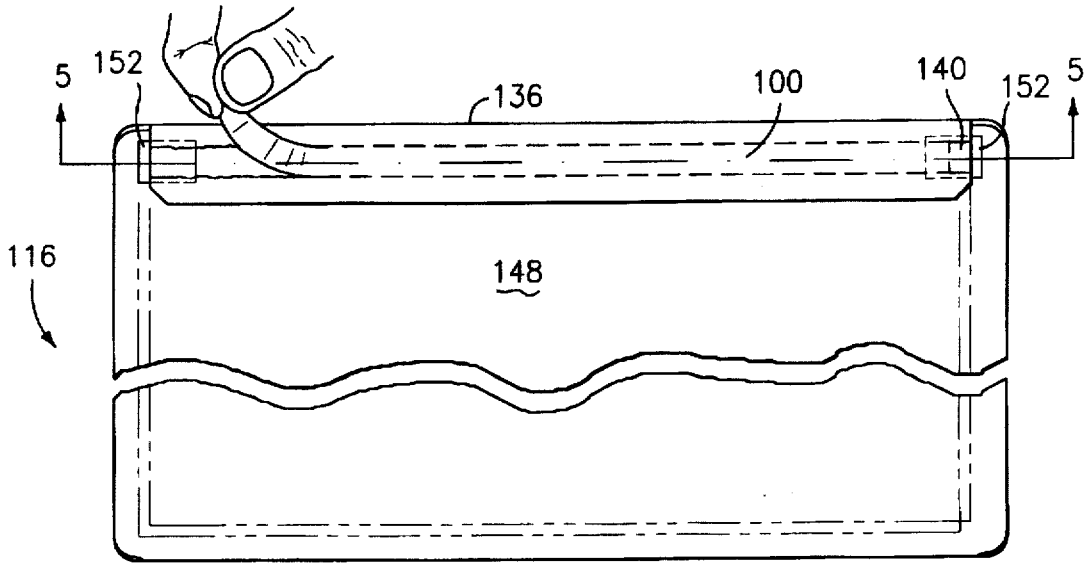
FIG. 4 is a similar view of that of FIG. 3, but with the flap folded over and the envelope sealed, and with the user in the process of opening the envelope by pulling on the strip of FIG. 1.
Figure 5:
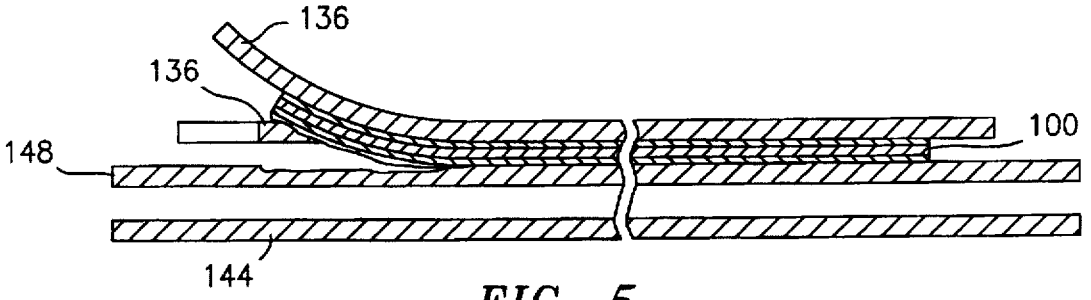
FIG. 5 is a cross-sectional view, taken along the lines 5—5 of FIG. 4, illustrating the package body material being torn by the strip of the present invention while the user is opening the envelope.

For use on the envelope of FIGS. 3–5, an exemplary thickness of the high strength membrane 104 may be 0.002 inches. The adhesive that is laminated or coated to both major, opposing surfaces of the flat, high strength membrane 104 may be a commercially-available, permanent, pressure-sensitive adhesive. The strength of the adhesive selected to be laminated or coated to the high strength membrane 104 is greater than the strength of the package material in the vicinity of the location of the strip 100 on the package 116 to allow the package fiberboard material to be cut or torn through when opening.

The release liner 120 may comprise a centrally-located, rectangular-shaped carrier 124 having a release material, such as silicone, laminated or coated in layers 128, 132 onto the two major opposing surfaces of the carrier 124. The release material of the inner layer 128 in contact with the strip adhesive layer 112 may be of a less-easy release nature than that of the outer layer 132. This is to insure that the release liner 120 adheres to the strip 100 until it is desired to seal the package, at which time the release liner 120 is removed from the strip 100 to which it was attached during manufacture.

Figure 2:
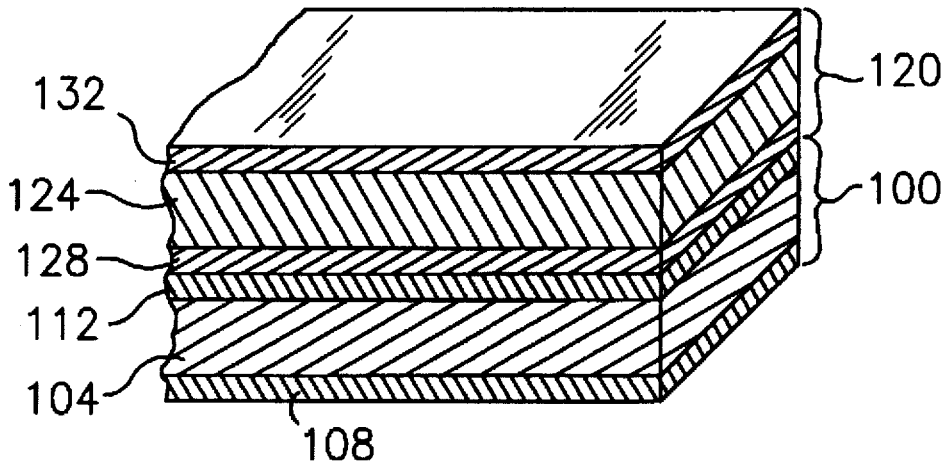
FIG. 2 is a cross-sectional view of an alternative embodiment of the strip and liner without the convenience of the "finger lift dry edge" for users in FIG. 1.

In a preferred embodiment illustrated in FIG. 1, the strip 100 is narrower in width than that of the release liner 120. That is, the release liner 120 extends beyond the strip 100 on one or both edges of the strip. This creates a "finger lift dry edge" or overlap of the release liner 120 with respect to the strip 100, which makes it easier for a user to grasp and remove the release liner 120 from its adherence to the strip 100 when it is desired to seal the package. Alternatively, FIG. 2 illustrates an embodiment where the strip 100 is of the same width as that of the release liner 120.

Because the strip 100 and the release liner 120 each has, in a preferred embodiment, a simple, rectangular shape and uniform thickness, the strip 100 and liner 120 may both be manufactured using standard and relatively simplistic manufacturing techniques. For example, the use of a differentially-coated release liner 120 allows the strip 100 and release liner 120 combination to be manufactured and stored in a continuous "roll form" until it is desired to apply the combination to the material comprising a package.

Through an integrated manufacturing process, the planar, rectangular-shaped, high strength membrane 104 is coated in layers 108, 112 on both of its opposing surfaces or sides with the high strength, pressure-sensitive adhesive, thereby forming the strip 100. During manufacture, the strip 100 is laminated on one of its adhesive coated sides to a differentially-coated release liner 120 and rolled up in a coil. Alternatively, two separate release liners may be utilized, with one liner being disposed on an adhesive-coated side of the strip 100. After unrolling, the rolled strip 100 is applied on its exposed adhesive-coated side to the package material at the desired location thereon. For example, for use with the envelope of FIGS. 3–5, the strip 100 is applied automatically to the inside surface of the upper flap 136 such that the inner adhesive layer 108 adheres to the package material while the opposite, outer adhesive layer 112 remains protected by the release liner until it is desired to seal the envelope 116. The strip 100 of the present invention provides a single manufacturing subassembly that can be applied at manufacturing speeds on package making equipment.

An advantage of the strip 100 of the present invention is that because of the shapes and natures of the materials utilized, the adhesive-coated strip 100 can be laminated directly to the various materials (e.g., fiberboard, cardboard, corrugated, plastic, etc.) comprising the different types of packages 116 (e.g., envelopes, cartons, boxes, pouches, etc.). The strip 100 can be applied to the raw package material prior to conversion of the raw material into a package 116. Thus, the combination of the strip 100 and release liner 120 provides for manufacturing convenience not present in prior art package sealing and opening systems.

Once the strip 100 is applied to the package material, before or after material conversion, in a location such as the flap 136 of the overnight-mail document envelope 116 of FIGS. 3–5, or an end panel of a box or carton, the person who loads the package 116 merely has to remove the release liner 120 from the strip 100 to expose the outer adhesive layer 112 of the strip 100. The flap 136 with the exposed strip 100 can then be folded down along a pre-formed fold line of the package 116 such that the flap 136 comes in contact with the package material, which will then seal the package 116 in an effective, tamper-resistant manner. The pre-formed fold line is normally formed in the package material anyway; thus, it is not an extra step that is required by the strip 100 of the present invention.

When applying the strip 100 to a package 116 such as an overnight envelope, the strip 100 is aligned with, e.g., the envelope flap 136, which may have (although not necessary) either a die-cut finger hole or tab, a spot of release material, or other type of package surface interruption located thereon to facilitate the start of the opening of the package 116. By proper placement of the package surface interruption, the fingers can easily grasp the interruption to start the opening of the package 116. In FIGS. 3 and 4, the package surface interruption is illustrated as comprising a pair of die-cut tabs 140 formed in the package flap 136 at the left and right sides of the flap 136. Each tab 140 comprises a pair of parallel cuts in the flap material. The cuts began at the outer left and right edges of the flap material and proceed inward past the ends of the strip 100 placed on the flap 136.

The die-cut tabs 140 may be formed either before or after the strip 100 and release liner 120 combination is laminated or adhered to the package material at the desired location. The tabs 140 are aligned with the strip 100, at application of the strip 100 to the package material, to ensure that the user who will open the package 116 has easy access to the tear-tab strip 100 for opening the package.

The typical overnight-mail, document envelope 116 illustrated in FIGS. 3–5 comprises two panels of fiberboard material, a front panel 144 and a rear panel 148, marginally joined together by, e.g., glue, to define a contents-enclosing area. The flap 136 is normally formed as an extension of the front panel 144 and is folded over to close the envelope. For use with the preferred embodiment of the strip 100 of the present invention, the outer surface of the rear panel 148 has a pair of release points 152 formed on the panel 148 in the shape of squares. Each release point 152 merely comprises ink printed onto the panel material. The printed release points 152 must be formed before the strip 100 and release liner 120 combination is laminated or adhered to the package material at the desired location. The release points 152 are aligned with the strip 100 at application of the strip 100 to the package material to ensure that the user who will open the package 116 has easy access to the tear-tab strip 100 for opening the package.

When the flap 136 is folded over in sealing the envelope 116, a portion of each release point 152 will be overlapped by a portion of the exposed adhesive-coated side 112 of the strip 100 at each end of the strip 100. The ink or release material causes the exposed adhesive-coated side 112 of the strip 100 to have relatively less adherence to the rear panel 148 of the envelope 116, as compared to the non-ink or release printed portion of the rear panel 148 that the adhesive adheres to. Thus, the release points 152, in conjunction with the die-cut tear-tabs 140, allow the user to more easily begin the process of opening the envelope 116 by tearing the fiberboard comprising the front panel 144, now folded over the rear panel 148, of the envelope 116. It should be understood, however, that the use of the die-cut tabs 140 formed in the flap 136, and the printed release points 152 are not required for the broadest scope of the present invention.

Once it is desired to open the package 116 to remove the contents, the user grabs one of the die-cut tabs 140, typically either the left tab or the right tab, depending on whether the user is left-handed or right-handed, respectively. As seen in detail in FIGS. 4 and 5, the user then pulls the tab 140, which causes the fiberboard comprising the rear panel 148 of the envelope 116 to tear. This also causes the flap 136 to tear in the outline of the strip 100, as seen in FIG. 4. The flap 136 and the rear panel 148 both tear because the high strength membrane 104 is stronger than the fiberboard material comprising both the flap 136 and the rear panel 148. Once the user has completed pulling the strip 100 and tearing the fiberboard material, the flap 136 is then released from adherence to the front panel 144 and the user now has access inside the envelope to retrieve the contents.

Figure 6:
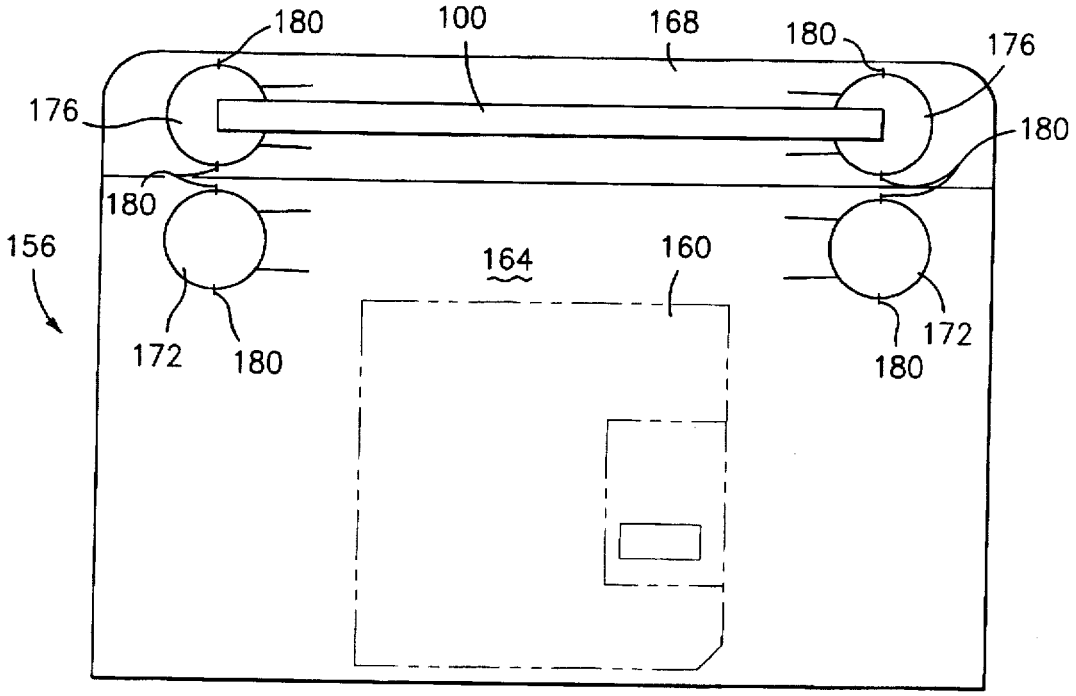
FIG. 6 is an application side view of an alternative embodiment of a package having the combination strip and release liner of FIG. 1 disposed onto the inside of the flap of the package.
Figure 7:
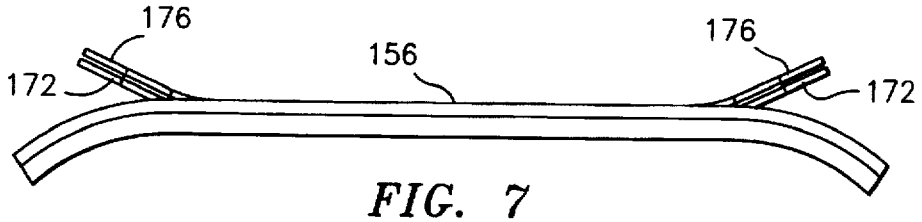
FIG. 7 is a top view of the sealed package of FIG. 6 with both sides partially folded or "bent" downward, thereby releasing the die-cut tabs formed in the package material.
Figure 8:
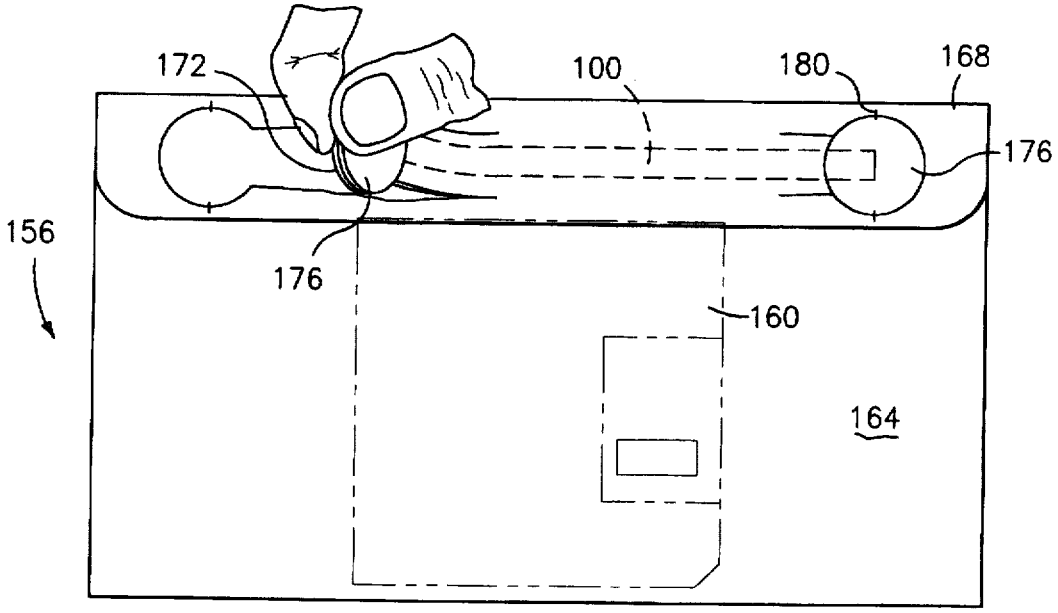
FIG. 8 is a similar view of that of FIG. 6, but with the flap folded over and the package sealed, and with the user in the process of opening the package.

Referring to FIGS. 6–8, there illustrated is an alternative embodiment of a package 156 used to hold and ship items, such as a computer floppy disk 160 shown in phantom. As used in this alternative package embodiment, the strip 100 of the present invention is identical to that used in the package embodiment of FIGS. 3–5.

The package 156 may comprise a single piece of fiberboard or other fibrous or non-fibrous material which is appropriately folded and marginally-sealed to form a contents-enclosing pouch. As an alternative to the printed ink release points 152 of the previous embodiment, the rear panel 164 and flap 168 of the package 156 may each have formed therein a pair of die-cut areas 172, 176 in the shape of, without limitation, circles, rectangles or other exemplary shapes. When the package 156 is sealed with the strip 100 of the present invention, the areas 172, 176 act as lifting tabs that are grasped by the user to facilitate opening of the package 156 by tearing the package material.

FIG. 6 illustrates the package in an open position and the strip 100 adhered to the inside of the flap 168. From FIG. 6 it can be seen that the left and right ends of the strip 100 are positioned over approximately one-half of each die-cut area 176. Similar to the embodiment of FIGS. 1–5, when it is desired to seal the package 156, the user merely peels the release liner 120 from its adherence to the strip 100 to expose the outer adhesive-coated side 112 of the strip 100. The flap 168 is then folded over along its fold line such that the adhesive-coated side 112 comes in contact with the rear panel 164 of the package 156. In such position, the left and right ends of the strip 100 will adhere to the die-cut areas 172 formed in the rear panel 164, thereby forming a three-layer laminate structure comprising the die-cut area 176 formed in the flap 168, the strip 100, and the die-cut area 172 formed in the rear panel 164.

All of the die-cut areas 172, 176 are connected during package manufacture to the remainder of the rear panel 164 and flap 168, respectively, by small connection points 180. Then, when it is desired to open the package 156, the user merely bends either or both of the left and right sides of the package to break the connection points 180. The areas 172, 176 will then "pop-up", as illustrated in FIG. 7, to facilitate their grasping by the user. The user then pulls the tear-tab along its length. Because the high strength membrane 104 of the strip 100 is stronger than the package material, the flap 168 and rear panel 164 of the package 156 will tear in a manner much like that of the package of FIGS. 3–5. The flap 168 will then be released and the package is opened for access to the inside thereof.

Also, the diameter of the circles formed as the die-cut areas 176 in the flap 168 may be slightly larger than the diameter of the circles formed as the die-cut areas 172 in the rear panel 164. This allows the areas 172, 176 to overlap each other and be adhered to each other for the various situations where the package 156 will contain contents (e.g., documents) of different thicknesses.

As discussed hereinbefore, numerous envelope and package sealing mechanisms have previously been developed to provide tamper-resistant, secure sealing. On the other hand, different systems exist to provide easy opening tear strips or mechanical cuts or perforations to facilitate opening without resorting to sharp instruments to cut through the package material to gain entry into the envelope. In contrast, the strip 100 of the present invention has utility in that it provides a single structure for sealing and opening a package 116, 156. When applied to package materials, the strip 100 of the present invention yields a highly reliable and flexible system adaptable to many different package formats, only two of which have been illustrated and described herein. It should be understood, however, that the strip 100 may be utilized on virtually any type of package comprising virtually any type of material, in light of the teachings herein. The strip 100 provides package users with the singular convenience of sealing and opening packages, while also providing for user security and convenience.

Due to the package die cutting process, the die-cut tabs 140, the printed release areas 152 and the die-cut areas 172, 176 can be located on the package material with reliable accuracy. When two levels require tab cuts 172, 176 on both the package rear panel 164 and the flap 168, the tab cuts 172, 176 are aligned to provide a laminated pop-up tear-tab when the package 156 is flexed or bent downward at the edges. On the other hand, when the tab cuts 140 are parallel lines with a cross cut to provide push/pull access, the cuts also require an accurate overlay position at sealing. All overlays (i.e., tear-tabs, tab cuts) are provided with placement accuracy by being at equal distance from the folding score line used for flap closure that is located in register with the other package attributes.

The strip 100 of the present invention has been described and illustrated herein as comprising a rectangular-shaped, three-layer laminate of materials; however, it is to be understood that the use of three layers and rectangular shape are strictly exemplary. It suffices for the broadest scope of the present invention that the strip comprise a material, such as a polymer, which is stronger than the package material and coated with appropriate adhesive, to provide for fiber tearing bond to controllably open the package 116, 156. The rectangular shape was chosen for ease of manufacturing and package application purposes.

Also, the use of a pressure-sensitive adhesive as a coating for the high strength membrane 104 is also strictly exemplary. Other types of adhesives may be utilized which should be apparent to one of ordinary skill in the art in light of the teachings herein. Further, the use of a three-layer laminate for the release liner 120 is also exemplary. Other commercially-available release liners 120 may be utilized without departing from the broadest scope of the present invention.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. A package having an article of manufacture selectively attached at a predetermined location on material comprising the package to effect a closure of at least a portion of the package, the article comprising a strip having a central membrane comprised of a material having a predetermined strength that is greater than the strength of the package material at the predetermined location, the strip comprising an adhesive layer attached to the central membrane, the adhesive layer having a predetermined strength that is greater than the strength of the package material at the predetermined location, a first portion of the adhesive layer being adapted to selectively attach to the package material at the predetermined location, a second portion of the adhesive layer being adapted to attach to the package, wherein the package material adjacent to the second portion of the adhesive layer and in attachment thereto has at least one tear-tab formed therein, wherein the package material at the predetermined location to which the first portion of the adhesive layer is adhered to upon at least the partial closure of package has at least one corresponding package interruption formed therein.

2. The package of claim 1, further comprising a release liner attached to the first portion of the adhesive layer, the release liner being adapted to prevent the first portion of the adhesive layer from contacting the package material at the predetermined location while the release liner is attached to the first portion of the adhesive layer.

3. The package of claim 2, wherein the release liner comprises a central carrier.

4. The package of claim 3, wherein the release liner further comprises at least one release layer attached to the central carrier, the at least one release layer being adapted to be in selective physical contact with the first portion of the adhesive layer, the at least one release layer being removed from physical contact with the first portion of the adhesive layer when it is desired to expose the first portion of the adhesive layer to subsequently make selective contact with the package material at the predetermined location.

5. The package of claim 2, wherein a width dimension of the release liner is greater than a corresponding width dimension of the strip, wherein when the release liner is attached to the strip there is an amount of dimensional overlap of the release liner with respect to the strip thereby allowing for easy grasping of an edge of the release liner to facilitate removal of the release liner from attachment to the strip.

6. The package of claim 1, wherein a shape of the central membrane and the adhesive layer is rectangular.

7. The package of claim 1, wherein the adhesive layer comprises a pressure-sensitive adhesive.

8. The package of claim 1, wherein the material comprising the central membrane is selected from the group consisting of flexible synthetic film, polyester, polymeric films, fiberglass, fibrous materials, and non-fibrous materials.

9. The package of claim 1, wherein the tear-tab is in the shape of a die-cut area.

10. The package of claim 1, wherein the tear-tab is in the shape of at least two parallel perforations.

11. The package of claim 1, wherein the package interruption comprises a die-cut area.

12. The package of claim 1, wherein the package interruption comprises at least one predetermined area printed with an ink.

13. The package of claim 1, wherein the package interruption comprises at least one predetermined area comprising a release material.

14. A package, comprising:

a. package material selectively formed into a predetermined shape to form a contents-enclosing area, the package material having a foldable flap that, when folded, is operable to seal the contents-enclosing area; and b. an adhesive-coated strip attached to an inner surface of the flap, the strip having a central membrane comprised of a material with a strength greater than the strength of the package material comprising the flap and greater than the strength of the package material at the location of the package material to which the strip is adhered to upon at least partial closure of the package by folding of the flap to come into contact with the package material, the strip having an adhesive coated onto a surface of the strip that comes into contact with the package material upon at least partial closure of the package;

c. wherein the flap has at least one tear-tab formed therein adjacent to the strip disposed on the inner surface of the flap, and wherein the location of the package material to which the strip is adhered to upon at least partial closure of the package has at least one package surface interruption formed therein, wherein the at least one tear-tab and the at least one package surface interruption comprise means for facilitating the opening of the package through a tearing of the package material adjacent to the strip.

* * * * *